US006041958A

United States Patent [19]

Tremelo

[11] Patent Number: 6,041,958

[45] Date of Patent: Mar. 28, 2000

[54] INSULATING FOLDABLE BOX FOR TRANSPORTATION AND PACKAGING PURPOSES

[75] Inventor: Michel Tremelo, Marseilles, France

[73] Assignee: Enthalpy S.A., Marseilles, France

[21] Appl. No.: 08/669,411

[22] PCT Filed: Jan. 9, 1995

[86] PCT No.: PCT/FR95/00024

§ 371 Date: Jul. 9, 1996

§ 102(e) Date: Jul. 9, 1996

[87] PCT Pub. No.: WO95/19302

PCT Pub. Date: Jul. 20, 1995

[30] Foreign Application Priority Data

Jan. 12, 1994 [FR] France ..... 94 00498

[51] Int. Cl.[7] ..... B65D 6/24; B65D 19/06

[52] U.S. Cl. ..... 220/4.28; 206/600; 220/6; 220/592.25; 220/617; 220/636

[58] Field of Search ..... 220/4.28, 1.5, 220/4.29, 4.31, 4.32, 6, 617, 636, 648, DIG. 9, 592.25, 592.03, 592.09, 592.1, 592.2; 206/386, 600; 217/48, 43 A

[56] References Cited

U.S. PATENT DOCUMENTS

| | | | |
|---|---|---|---|
| 3,502,237 | 3/1970 | Verhein et al. | 220/4.28 |
| 3,527,339 | 9/1970 | Cipolla | 220/6 X |
| 3,853,238 | 12/1974 | Luisada et al. | 220/4.28 X |
| 4,844,263 | 7/1989 | Hadtke | 206/509 X |
| 5,289,933 | 3/1994 | Streich et al. | 220/4.31 X |
| 5,323,921 | 6/1994 | Olsson | 220/6 X |

FOREIGN PATENT DOCUMENTS

| | | |
|---|---|---|
| 0146436 | 6/1985 | European Pat. Off. . |
| 1334495 | 6/1962 | France . |
| 2654703 | 11/1989 | France . |
| 369881 | 5/1991 | Switzerland . |
| 8912003 | 12/1989 | WIPO . |

*Primary Examiner*—Allan N. Shoap
*Assistant Examiner*—Niki M. Eloshway
*Attorney, Agent, or Firm*—Ladas & Parry

[57] ABSTRACT

The technical field of the invention is that of manufacturing boxes or cases or other packaging volumes which are foldable so as to be transportable in a minimum amount of space when empty: the present invention relates to such rectangular boxes comprising a base, four side faces of held thereon by a rim with two opposite ones of said faces being interconnected by foldable side elements enabling said two walls, when disconnected from the base, to be pressed one against the other, and a lid panel covering and holding said side faces remotely from the base; the two said interconnected faces are rigid insulating panels, the two lateral elements interconnecting them are belt portions, and the other two opposite faces are likewise insulating panels that are independent and that slide between the two first faces and against said belts when they are unfolded.

8 Claims, 2 Drawing Sheets

INSULATING FOLDABLE BOX FOR TRANSPORTATION AND PACKAGING PURPOSES

FIELD OF THE INVENTION

The present invention relates to insulating foldable boxes for transportation and packaging purposes.

The technical field of the invention is that of manufacturing boxes or cases or other packaging volumes which can be folded in order to be transported in a minimum amount of space when empty.

BACKGROUND OF THE INVENTION

The main specific application of the invention is making such cases, or boxes, or other volumes which are insulating for the purpose of transporting or storing merchandise that need to be maintained at a temperature that is as stable as possible, in particular for small quantities of merchandise that are sensitive to extremes of temperature and to sudden changes of temperature, such as foodstuffs, pharmaceuticals, chemicals, etc. . . . .

One of the main applications of the invention is assembling such cases or boxes or other volumes which are self-supporting, stackable, and suitable for handling on pallets by forklift handling equipment.

Such foldable cases or boxes are known for transporting all types of merchandise, but without seeking to provide thermal insulation, and they are therefore unsuitable for the above purpose unless insulating panels are added to the insides of the walls once they have been assembled to create a packaging volume, thereby increasing the number of components required for building such a volume, complicating assembly, increasing the folded volume of the kit, and naturally also increasing its weight which is disadvantageous for transportation by air, and also decreasing the volume available for packaging, which makes such cases expensive.

In the field of foldable boxes and cases for packaging and transportation purposes, various patent applications are to be found, in particular for solving problems either to do with strength to enable them to be stacked, or else to do with manufacture, to reduce costs and to simplify assembly by optimizing the cutting out of mutually folding walls as well as possible. By way of example, to achieve the first objective, mention may be made of French patent application 2 654 703 published on May 24, 1991 in the name of ECOPAL for a "foldable pallet case". For that purpose, that document describes a rectangular pallet made essentially of wood, supporting a skirt which, in the deployed state, is in the form of a rectangular parallelepiped having open bottom and top faces, and in which each of two opposite transverse faces has a respective vertical fold line substantially in the middle subdividing it into two half-faces, thereby enabling said skirt to be folded concertina-like, and such as to enable it to be provided with two stiffening elements of shape and size corresponding substantially to the shape and size of said foldable transverse faces. Since the elements are fixed to the inside of the skirt, each to one of the two half-faces of the two transverse faces, they do indeed ensure that the pallet case is self-supporting and strong enough for them to be stacked with other such cases, while nevertheless making it possible for it to occupy a small volume once folded, given the ability of the kit to be disassembled and folded. Nevertheless, because the skirt is disposed as a continuous belt and includes two rigid elements on the insides of its foldable walls, the range of dimensions that are possible for the case is limited. Also, that disposition does not enable the other two faces also to be strong enough to be self-supporting, since that would not enable the set of side faces to hold together nor would it guarantee stability for the case as a whole. Furthermore, if it desired for such a foldable pallet case to be insulating, then it is still necessary to add pre-cut insulating elements inside it.

Mention may also be made of French patent 2 535 288 published on May 4, 1984, and filed by PAPETERIE LEON CLERGEAU and L'HEXAGONE, entitled "foldable self-supporting case for packaging and transport purposes and usable as a display unit". That document describes a foldable case in the shape of a rectangular parallelepiped, which case is constituted by a preassembled web comprising a single card blank made of a material having good mechanical strength, with cutouts and folds making it possible, on setting up its volume, to obtain a bottom and two opposite side walls of the package, each having lateral strips coming back at right angles for the purpose of stiffening the corners formed, with connections between the strips being provided by tongues that are fixed by adhesive. The side walls are held in the unfolded position by installing one or both of the other side walls that are continuous and received in the angles of the two opposite unfolded walls. The base element may be fitted with studs or wooden bars of thickness and spacing determined to enable the package to be handled by a forklift truck, and if it is desired to improve the stacking strength of the package, the strength of each of the angles is increased by the presence of return-forming strips serving to line the corner in each angle of the package.

The objective of that second patent is above all to solve a manufacturing problem by minimal cutting of a single base sheet of card, and to make it possible to provide a package that is capable of serving as a display unit. However in that case also, if it is desired to obtain an insulating package, it is necessary to add elements to the inside thereof. In addition, its suitability for stacking with other packages is rather limited, since it has no genuinely stiff element other than the corner angles for supporting heavy loads.

It can thus be seen that for each particular application, and depending on the specific problem posed, it is necessary to develop a folding system adapted thereto, and at present there exists no such system suitable for making directly an insulating box that is foldable and of sufficient strength, without any need to add additional panels for that purpose inside a standard volume.

OBJECTS AND SUMMARY OF THE INVENTION

The problem posed is to be able to assemble directly and in simple and rapid manner, walls of a foldable box or case suitable for imparting an insulating nature thereto, while simultaneously ensure that the resulting case or box is both sufficiently rigid to be capable of being handled together with merchandise therein without any risk of deforming the outside volume thereof, and also sufficiently strong to support loads stacked thereon; such boxes or cases must therefore be foldable using a minimum number of elements that are independent and separable and it must require no additional assemblies, and once disassembled and stacked they should occupy as small amount of space as possible; in addition, it must be possible to handle them with forklift handling equipment as used in air transportation, for example, which also requires the overall weight to be as small as possible for a maximum packaging volume.

A solution to the problem posed is a foldable rectangular box for transportation and packaging purposes comprising a plane base, four side faces of dimensions compatible with the four sides of said base, held thereon by a rim of said base, and with two opposite ones of said side faces being interconnected by two foldable side elements which extend along the other two sides of the base, enabling said two walls, when disconnected from the base, to be pressed one against the other, and a lid panel for closing the box, likewise having a rim that overlies and holds said side faces remotely from the base. Said two opposite and interconnected, or "first", faces are rigid insulating panels; the two side elements that interconnect them are thin belt portions; and the other two, or "second", opposite faces are likewise insulating panels that are independent and that slide between the two first faces and against said belt portions when they are unfolded.

To obtain overall rigidity for the box once made by assembling together the various above elements, the two opposite and removable side panels are of a height equal to the sum of the heights of the other opposite and interconnected side panels plus at least the thickness of an insulating panel situated in the lid; the length of the lid panel is equal to the difference between the length of the shorter opposite and interconnected side panels and twice the thickness of the taller opposite and removable side panels, and its width is equal to the length of the taller panels.

Preferably, the bottom portions of the four side panels rest on the base which is provided with a rim that holds them, and at least the two removable side panels rest on the inside bottom of said base. Preferably, the length of the interconnected side panels is equal to the length of the inside bottom of the base while the length of the removable panels is equal to the width of said bottom less twice the thickness of said interconnected side panels, and said four side panels rest on said inside bottom of the base surrounding an insulating panel situated on the bottom.

Thus, the self-locking of the edges of the various panels to one another ensures stability of the various elements relative to one another by mutual engagement held by the rims of the bottom and of the lid, thereby also guaranteeing that the internal packaging volume of the assembly is rigid and not externally deformable during handling.

In a preferred embodiment, each of the rigid insulating panels forming the faces of the box of the invention is formed by a plate that is several centimeters thick, the core thereof being made of a semirigid cellular material of the expanded polystyrene or card honeycomb type, and with at least one of the faces thereof being covered in a material that has a reflecting surface.

To achieve the objective of the boxes being self-supporting and capable of being stacked one on another, at least the four rigid insulting panels forming the four side faces are of sufficient thickness and made of a material such as to enable them to support the weight of at least one other box placed on the lid and full of merchandise with a relative density less than or equal to 1.

To achieve the objective of the boxes being suitable for handling with fork handling equipment, the bottom portion of the base is supported by blocks for raising it above the ground, that are secured to and fixed beneath said base, e.g. such as studs or bars disposed in parallel and far enough apart to allow the case to stand on the ground or on another case, and to enable the forks of a forklift truck to pass between them.

The result is novel foldable boxes for transportation and packaging purposes which are insulated and which satisfy the objectives mentioned above, i.e. essentially for it to be possible to assemble together the dismantleable walls of said box or case directly in a manner that is simple, quick, and without requiring any additional assembly, and imparting an insulating character to the walls, given that the walls used are themselves insulating panels; because of the characteristics of the invention, the assembly enables mutual engagement to be performed that is rigid enough to be capable of being handled with merchandise inside, and the thickness and the structure of said panels can be sufficiently strong to be able to support loads stacked on the case made up therefrom. This is not possible, even in existing cases where insulating wall elements are added to the inside but are not held to one another so they can still move, unless they are stuck into place or they are cut out to the shape of the merchandise they are to receive, which can only be done on a small scale, is lengthy, and more expensive.

The concept of obtaining insulation by the very structure of the container makes it possible to reduce the number of elements required by the resulting dismantleable box or case, which is made easier to dismantle thereby, which can be implemented quickly, and naturally without using any special assembly tool, since assembly can be performed by hand.

By reducing in this way the number of component elements making up the insulating box, it is possible to reduce the overall weight thereof; in addition the elements may be made of an insulating material of cellular type in a honeycomb configuration, made of cardboard, and suitable for providing packaging that is suitable for being discarded, thus providing an additional advantage.

Other advantages of the present invention could be mentioned, but those given above suffice already to demonstrate the novelty and the advantage thereof.

BRIEF DESCRIPTION OF THE DRAWINGS

The following description and figures show an embodiment of the invention, but are not limiting in any way: other embodiments are possible within the ambit of the scope and of the extent of the invention, in particular by changing the respective dimensions of the various panel elements relative to one another.

MORE DETAILED DESCRIPTION

Figure 1:
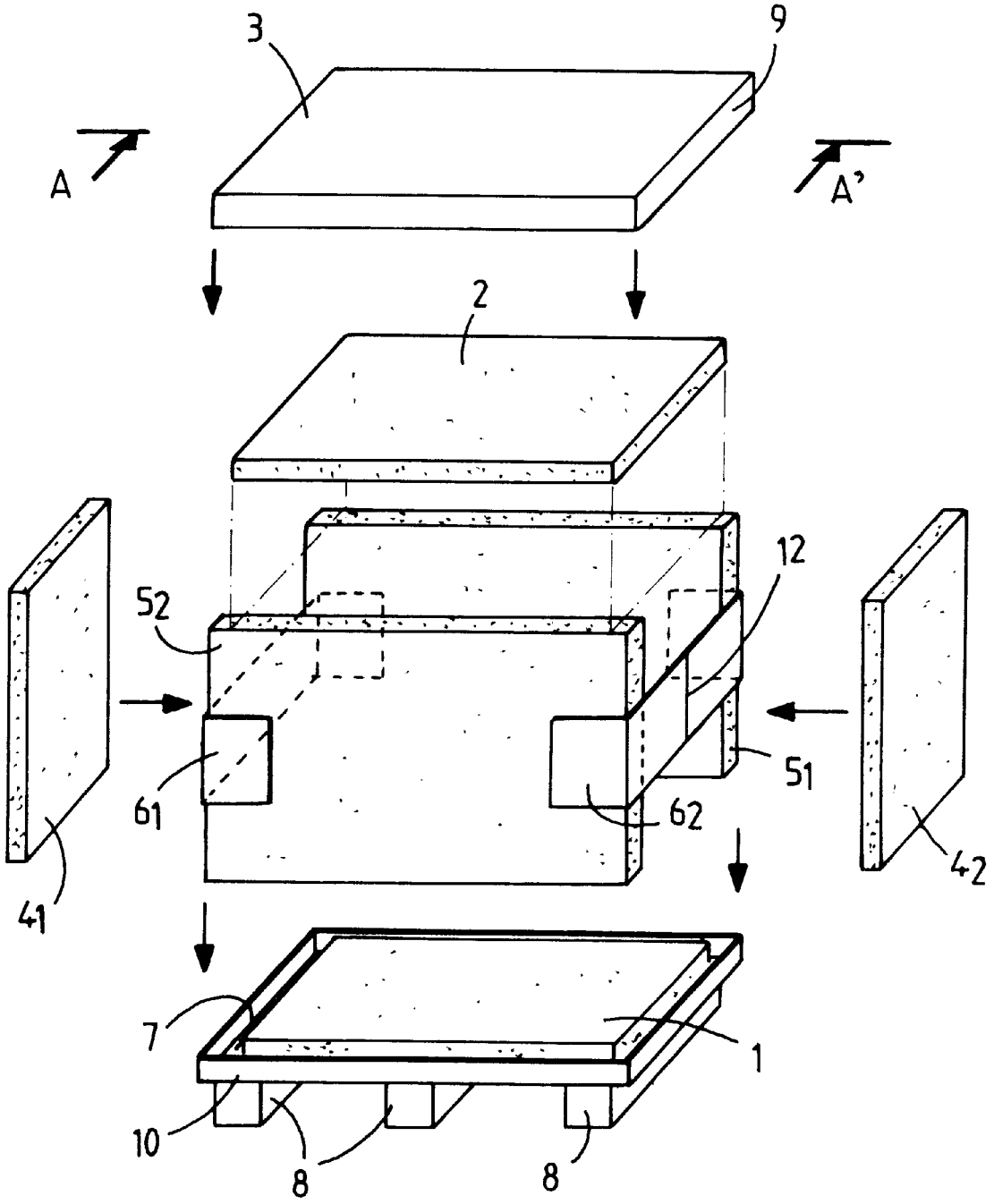
FIG. 1 is a perspective view of the various elements of a case of the invention shown disassembled and unfolded, ready to be assembled together to constitute the case.
Figure 3:
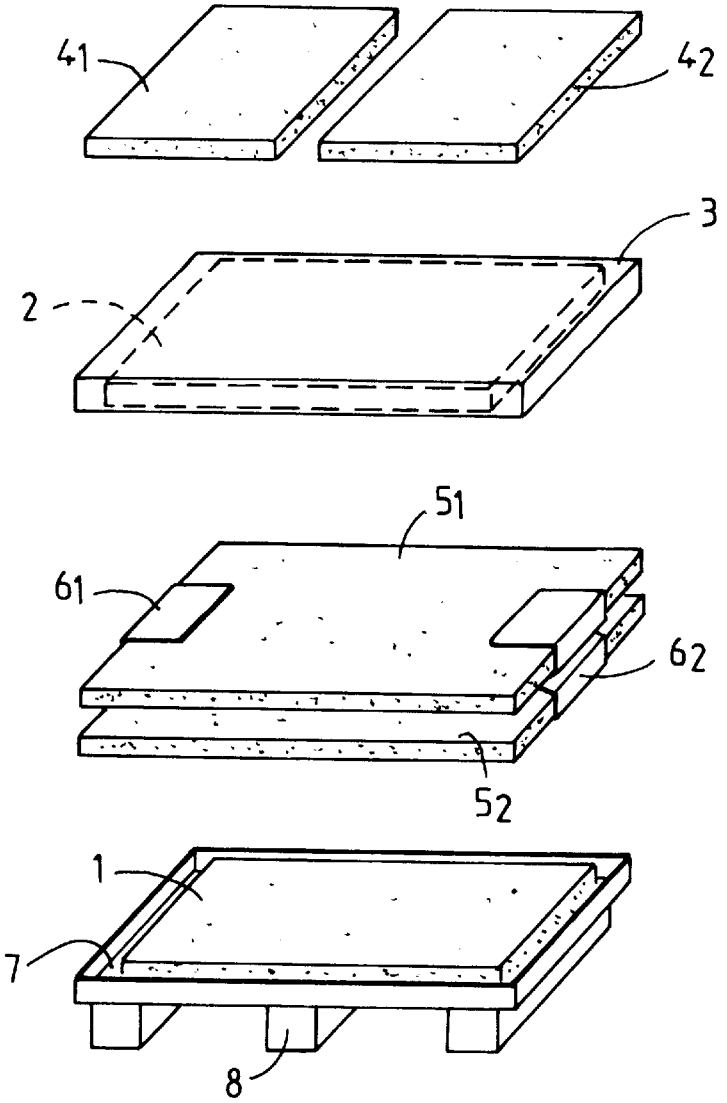
FIG. 3 is a perspective view of the various disassembled elements of a box of the invention ready to be stacked for storage in the empty condition.

In FIG. 1, the foldable rectangular box of the invention for transportation and packaging purposes comprises, in known manner, a plane base 7, four side faces of dimensions compatible with the four sides of said base, and held thereon by an upwardly extending rim 10 thereof which is preferably a peripheral rim. Two of said opposite side faces are interconnected by side elements which are disposed along the other two sides of the base 7 and which are foldable, e.g. in concertina-like manner, by a fold 12 that is in the middle, for example, enabling said two walls 5, once disconnected from the base 7, to be pressed one against the other, as shown in FIG. 3. A lid panel 3 for closing the box also has a rim 9 which serves to overlie and hold together said side faces remotely from the base 7.

According to an essential characteristic of the invention, said two opposite and interconnected faces 5 which may be referred to as "first" faces, are rigid insulating panels, and the two side elements that interconnect them are thin belt portions that naturally need not to be insulating, and that occupy only a fraction of the height of the panels $5_1$ and $5_2$ that they hold together, e.g. occupying only one-third of said height and placed at equal distances from the tops and the bottoms of the panels. These belt portions $6_1$ and $6_2$ may constitute a single belt surrounding all of the side panels, or they may comprise strip portions stuck or otherwise fixed to the edges of the panels they interconnect. They may be made of card, of corrugated card, or of any other flexible material, such as textile webbing or plastics material.

The other two opposite faces, that may be referred to as "second" faces 4, are likewise insulating panels that are independent and therefore removable relative to the first faces, being suitable for sliding between them and against said belt portions when the belt portions are unfolded.

The length of said removable side panels $4_1$ and $4_2$ must correspond exactly to the unfolded length of said belts $6_1$ and $6_2$, possibly together with a small amount of rubbing against the other side panels $5_1$ and $5_2$, essentially to ensure better insulation, given that the self-locking function is provided by the panels engaging in the bottom and in the lid, as described below.

Figure 2:
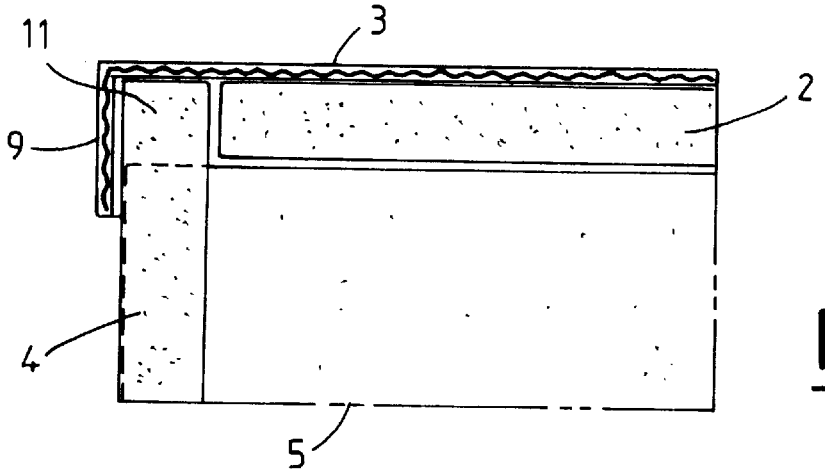
FIG. 2 is a section through an angle of a box of the invention, once assembled and closed.

With reference to FIG. 2, which is a fragmentary section on AA' of FIG. 1, once the elements making up the foldable box have all been assembled together and closed, the two opposite removable side panels 4 are of a height equal to the sum of the height of the other two opposite and interconnected side panels 5 plus at least the thickness of an insulating panel 2 situated in the lid. The length of the lid panel 2 is equal to the difference between the length of the shorter connected-together opposite side panels 5 and twice the thickness of the taller removable opposite side panels 4, and the width of said insulating panel of the lid 2 is equal to the length of said taller panels, thereby enabling it to bear against the interconnected side panels 5. The rim 9 of the lid 3 fits round the outside of the removable side panels 4 which can thus slide between the insulating panel of the lid 2 and said rim, thereby causing the top edges of the removable panels 4 to be held in place, and ensuring that the box as a whole is rigid against any external deformation of its volume.

Further, if at least the four rigid insulating panels 4 and 5 forming the four side faces are of sufficient thickness, and if they are made of a material that enables them to support the weight of at least one other reasonably full box, e.g. full of merchandise having a relative density not exceeding one, and placed on top of the lid 3, this makes it possible to ensure that said boxes can be stacked on one another.

The edges of the bottom portions of the four side panels 4 and 5 preferably stand on the base 7 which is provided with a rim 10 that holds them and the two removable side panels 4, at least. They stand on the inside bottom of said base 7 with an insulating panel situated on the bottom being inserted between them, thereby providing the same rigidity by mutual engagement with the rim 10 as is provided at the top, and as described in FIG. 2. Instead of using a rim 10, the bottom edges of the side panels 4 and 5 could be held in place by the belt elements, in which case they would go all the way down to the level of the bottom.

However, since there is no need to support the insulating panel 1 in the same manner as the lid 2 which needs to rest on said side walls $5_1$ and $5_2$, said interconnected other panels $5_1$ and $5_2$ can have bottom edges that rest either on said insulating bottom 1 as against the lid panel, or else directly on the bottom 7, in which case the width of the insulating bottom panel 1 is inserted between them.

Thus, and preferably, as shown in FIGS. 1 and 3, the length of the connected-together side panels 5 is equal to the length of the inside bottom of the base 7 and the length of the removable panels 4 is equal to the width of said bottom minus twice the thickness of said interconnected side panels 5, and all four of said side panels 4 and 5 stand on said inside bottom of the base 7, running around the periphery of the bottom panel 1.

In FIG. 1, the insulating panel of the lid 2 is shown as being disconnected from the lid 3 proper, however they may be permanently assembled together, e.g. by adhesive, as shown in FIG. 3, and the same can apply to the bottom panel 1 relative to the base 7.

In this case, when the foldable box of the invention is disassembled, the elements that make it up comprise no more than five separate elements which can be disposed as shown in FIG. 3, having a total thickness of five times the thickness of the insulating material constituting the panels, plus the height of optional supporting studs 8. If said foldable box is to be made suitable for handling by a forklift truck, then the bottom portion of the base 7 is supported by attached blocks 8 for holding it above the ground, constituted by studs or bars, for example, and fixed to said base in a disposition that enables forks to pass while also supporting the box when placed on the ground or on another box capable of receiving it. The blocks may be of any shape, being at least 9 cm high, and they may be made of wood as in present-day known pallets, or they may be blocks of card of structure similar to that of the insulating panels forming the faces and the walls, or they may be blocks made by molding compressed card.

Because the various elements can be disassembled and because the side walls $5_1$ and $5_2$ and also the side walls $4_1$ and $4_2$ can be separated, it is possible to use a single type of bottom 1, 7 and of lid 2, 3 with a plurality of different types of side walls of different heights for the purpose of making up different internal volumes, depending on the height used. Given that the standard for aviation type pallet cases is a width of about 1 meter, a length of 1.50 meters, and a height of 1 meter, and because of the interchangeability of said side panels 4 and 5, it is possible to obtain cases having heights of 0.50 meters, 1 meter, 1.50 meters, etc. . . . , using the same bottoms and lids, thus enabling a degree of module standardization, with some elements being in common.

In order to ensure that the side walls are simultaneously insulating and rigid, and also that the same applies to the bottom panel 1, and to the lid panel 2, the rigid insulating panels forming said faces are constituted by a plate having a thickness of several centimeters, preferably at least 2 cm for the dimensions given above and capable of supporting a thrust load of 1 (metric) tonne; the core 11 of such plates is made of a semirigid cellular material such as expanded polystyrene, or polyurethane, or PVC, or a card honeycomb, or a synthetic material having a cell diameter of less than 35 mm, together with two covers, one on each plane face, e.g. sheets of card or of synthetic material, such as a plastic.

At least one of the faces of the panels is covered in a material that constitutes a reflecting surface. This face is naturally preferably directed towards the inside of the volume of the foldable box when assembled for receiving the intended merchandise. The reflecting face which is preferably smooth and shiny may be a film of aluminized polyester on gray Kraft paper, or a laminate of aluminum sheets having a thickness of one micron stuck to Kraft paper, or even a gloss paint applied directly to the covering of the panel face.

The structure of such single-piece panels made up of self-supporting plates makes it possible for them to omit any stiffener for their own support, or to support the reflecting sheets, the panel itself, and the insulating material constituting it, as has been necessary in the techniques used in the past for making foldable cardboard boxes.

What is claimed is:

1. A kit of components for a rectangular-faced box, the kit comprising:

first and second identical, thermally insulating, rectangular and rigid side face panels, each of the first and second side face panels having opposite top and bottom side faces and opposite end edges;

first and second flexible belts respectively connecting between only portions of respective ones of the opposite end edges of the first and second side face panels for superimposing opposite faces of the side faces of the first and second side face panels when the belts are flexed and spacing the opposite faces of the side faces of the first and second side face panels a distance when the belts are unflexed;

third and fourth identical, thermally insulating, rectangular and rigid side face panels that are always independent of the first and second panels and belts, each of the third and fourth side face panels having top and bottom edges and opposite end edges spaced by the distance for abutting between the opposite faces of the first and second side face panels at the end edges of the first and second side face panels when the belts are unflexed; and top and bottom, independent, thermally insulating panels respectively having rims for overlying and holding the top and bottom side faces and edges of the side face panels when so abutted, whereby to form a rectangular-faced box.

2. The kit according to claim 1, wherein the third and fourth side face panels each have a height between their top and bottom edges equal to the sum of a height of the first and second side face panels between their top and bottom side faces plus at least the thickness of an insulating panel situated in the center of the top panel and spaced from the rim thereof, and a length equal to the difference between a length of the first and second side face panels between their end edges and twice a thickness of the third and fourth side panels, and wherein a width of the top panel is equal to the length of the third and fourth side face panels between their end edges.

3. The kit according to claim 1, wherein at least the third and fourth side face panels rest on an inside of said bottom panel in the box.

4. The kit according to claim 3, wherein a length of the first and second side face panels is equal to an inside length of the bottom panel, a length of the third and fourth side face panels is equal to an inside width of the bottom panel less twice a thickness of the first and second side panels, and all of the side face panels rest on the inside of the bottom panel in the box.

5. The kit according to claim 1, wherein each of the first, second, third and fourth side face panels is a plate that is several centimeters thick, a core of each thereof being made of a semirigid cellular material of expanded polystyrene or honeycomb card, and at least one face of each thereof being covered in a material that is reflecting.

6. The kit according to claim 5, wherein at least the first, second, third and fourth side face panels are of sufficient thickness and made of a material such as to enable them to support the weight of at least one other said box placed on the top panel and full of merchandise with a relative density of less than or equal to 1.

7. The kit according to claim 1, wherein at least the first, second, third and fourth side face panels are of sufficient thickness and made of a material such as to enable them to support the weight of at least one other said box placed on the top panel and full of merchandise with a relative density of less than or equal to 1.

8. The kit according to claim 1, wherein a bottom portion of the bottom panel has blocks that are secured or fixed thereto.

* * * * *